US008448389B2

(12) United States Patent
Doneux et al.

(10) Patent No.: US 8,448,389 B2
(45) Date of Patent: May 28, 2013

(54) SOUND TRANSMISSION REDUCING CONSTRUCTION ELEMENTS

(76) Inventors: Philippe Pierre Marie Joseph Doneux, Annandale (AU); Bela Takacs, Mt. Riverview (AU)

( * ) Notice: Subject to any disclaimer, the term of this patent is extended or adjusted under 35 U.S.C. 154(b) by 1040 days.

(21) Appl. No.: 11/578,340

(22) PCT Filed: Apr. 11, 2005

(86) PCT No.: PCT/AU2005/000520

§ 371 (c)(1),
(2), (4) Date: Nov. 15, 2007

(87) PCT Pub. No.: WO2005/100709

PCT Pub. Date: Oct. 27, 2005

(65) Prior Publication Data

US 2008/0314680 A1 Dec. 25, 2008

(30) Foreign Application Priority Data

| | | |
|---|---|---|
| Apr. 15, 2004 | (AU) | 2004902021 |
| Aug. 10, 2004 | (AU) | 2004904486 |
| Nov. 22, 2004 | (AU) | 2004906645 |

(51) Int. Cl.
*E04B 1/82* (2006.01)

(52) U.S. Cl.
USPC ..... 52/144; 52/309.8; 428/34.5

(58) Field of Classification Search
USPC ..... 52/144, 309.8, 309.14, 309.9, 407.1, 52/506.01; 428/34.5
See application file for complete search history.

(56) References Cited

U.S. PATENT DOCUMENTS

| | | | | |
|---|---|---|---|---|
| 3,652,360 | A | 3/1972 | Hartman et al. | |
| 4,406,657 | A | 9/1983 | Curutcharry | |
| 4,851,271 | A * | 7/1989 | Moore et al. | 428/34.5 |
| 5,502,931 | A | 4/1996 | Munir | |
| 5,945,643 | A | 8/1999 | Casser | |
| 6,006,484 | A | 12/1999 | Geissbuhler | |
| 6,183,862 | B1 * | 2/2001 | Ko et al. | 428/354 |

FOREIGN PATENT DOCUMENTS

| | | | |
|---|---|---|---|
| EP | 0 037 785 | B1 | 10/1981 |
| EP | 0 278 393 | A2 | 8/1988 |
| EP | 0 461 328 | | 12/1991 |
| EP | 0 461 328 | A1 | 12/1991 |
| EP | 0 864 712 | | 9/1998 |
| EP | 0 864 712 | B1 | 9/1998 |
| FR | 669833 | A | 11/1929 |
| FR | 2727450 | | 11/1994 |
| FR | 2727450 | | 5/1996 |
| FR | 2811350 | | 7/2000 |
| FR | 2 811 350 | | 1/2002 |
| FR | 2811350 | | 1/2002 |
| FR | 2816240 | A1 | 5/2002 |
| GB | 1 514 516 | A | 6/1978 |
| JP | 2001-142466 | | 11/1999 |
| JP | 2001 142466 | | 5/2001 |
| JP | 2002-70200 | | 3/2002 |
| JP | 2002 070200 | | 3/2002 |
| WO | WO93/21402 | | 10/1993 |
| WO | WO 01/96695 | A1 | 12/2001 |

* cited by examiner

*Primary Examiner* — Basil Katcheves
(74) *Attorney, Agent, or Firm* — King & Schickli, PLLC

(57) ABSTRACT

According to one aspect of the present invention there is provided an acoustic laminate suitable for use in wall, floor and ceiling assemblies and other dividing structure assemblies, the laminate including: a viscoelastic acoustic barrier being in the form of discrete, spaced apart sections or a continuous layer; and a construction panel, the barrier affixed to one or more panel faces of the construction panel.

19 Claims, 10 Drawing Sheets

SOUND TRANSMISSION REDUCING CONSTRUCTION ELEMENTS

FIELD OF THE INVENTION

This invention relates to construction elements suitable for use in constructing internal or external walls, ceilings, roofs, floors and the like—where reduction of transmission of sound from one side to another is important.

BACKGROUND TO THE INVENTION

The sound transmission loss of a wall partition, ceiling, roofs or floor are determined by physical factors such as mass and stiffness. A complex interplay of factors works to prevent or allow the transmission of sound through surfaces. In a double layer assembly, such as plasterboard on wood or metal framing, the depth of air spaces, the presence or absence of sound absorbing material, and the degree of mechanical coupling between layers critically affect sound transmission losses.

The mass per unit area of a material is the most important factor in controlling the transmission of sound through the material. The so-called mass law is worth repeating here, as it applies to most materials at most frequencies:

$$TL=20\log_{10}(m_s f)-48.$$

where:

TL=transmission loss (dB)

$m_s$=mass per unit area (kg/m$^2$)

f=frequency of the sound (Hz)

Stiffness of the material is another factor which influences TL. Stiffer materials exhibit "coincidence dips" which are not explained by the above mass law. The coincidence or critical frequency is shown by:

$$f_c=A/t$$

where: A is a constant for a material t is the thickness of the material (mm)

There are other factors in wall, roof, ceiling & floor design such as the mass-air-mass resonance, which also affect transmission loss at different frequencies.

Generally, relying only on the mass law to achieve a specific TL results in a thick wall, ceiling or floor construction, which reduces usable floor area and ceiling height in an apartment dwelling. Attempts to avoid those coincidence dips noted above appear only to increase transmission loss slightly, if at all. Generally only very expensive and labour intensive solutions give an acceptable transmission loss. Building regulations are becoming more strict while more apartment blocks are being constructed, with cost being a pre-eminent factor.

The Sound Transmission Loss of a dividing structure separating two spaces varies with frequency. If the structure has a degree of stiffness, incident acoustic energy causes the structure to vibrate which re-radiates the acoustic energy on the other side of the structure. Low frequency re-radiation is mainly controlled by the structure stiffness. At about an octave above the lowest resonance frequency of the barrier, the mass of the structure takes over control of the re-radiation and dominates the sound reduction performance, and the mass law (above) indicates that doubling the mass of the structure increases the structure's noise attenuation performance by approximately 6 dB.

High frequency incident acoustic energy causes ripple-, or bending-waves of the surfaces of the structure. Unlike compression waves, the velocity of bending waves increases with frequency. Every 'stiff panel construction' has a critical or coincidence frequency which considerably reduces the Sound Transmission Loss of structural panel construction.

A common coincidence frequency occurs between 1000 & 4000 Hz and is caused by the bending wave speed in the material equaling the speed of sound in the medium surrounding the panel (in this case air). In this frequency range the waves coincide and reinforce each other in phase, greatly reducing the noise reduction performance of the panel at approximately the critical frequency.

The present invention seeks to ameliorate one or more of the abovementioned disadvantages of known methods of increasing TL such as higher cost, mass & reduced available space.

The present invention seeks to provide a construction partition panel laminate which improves acoustic transmission loss from one side to another.

SUMMARY OF THE INVENTION

According to one aspect of the present invention there is provided a construction panel laminate suitable for use in partition wall assemblies and having improved acoustic properties, the construction panel laminate including: a first flat construction panel; a viscoelastic acoustic barrier material layer affixed to the first flat construction panel.

Preferably the viscoelastic acoustic barrier material layer is in the form of discrete viscoelastic acoustic barrier material portions spaced across the construction panel.

According to one aspect of the present invention there is provided an acoustic laminate suitable for use in wall, floor and ceiling assemblies and other dividing structure assemblies, the laminate including: a viscoelastic acoustic barrier being in the form of discrete, spaced apart sections or a continuous layer; and a construction panel, the barrier affixed to one or more panel faces of the construction panel.

Preferably the construction panel is plasterboard, medium-density fibreboard, plywood, fibre-cement sheeting or timber.

Throughout this specification, the phrase "construction panel" is to be taken to include those flat panels constructed from plasterboard, plywood, glass-reinforced plastics, medium-density fibreboard, fibre-cement sheeting, timber, fibreglass, composites such as carbon fibre, and other sheets used in domestic construction of partition walls. Excluded from the definition are steel sheets, aluminium and aluminium honeycomb, C-beams, I-beams, structural supports and the like.

Preferably the construction panel is affixed to the viscoelastic acoustic barrier layer by adhesive.

Preferably the viscoelastic acoustic barrier is poured onto the construction panel and cures on the panel, bonding to the panel during curing.

Preferably the viscoelastic acoustic barrier layer is affixed to the construction panel in strips along an axis parallel to respective panel faces.

Preferably a matrix of viscoelastic pads are affixed to the construction panel across respective panel faces.

Preferably a second layer of construction panel is affixed to an outer face of the viscoelastic barrier or strips or pads in order to provide a three-layer laminate, for captive-, or constrained-layer damping-type effect.

Preferably the viscoelastic acoustic barrier layer has a density within a range of 1000 kg/m$^3$ to 3000 kg/m$^3$.

Preferably the viscoelastic acoustic barrier layer has a surface density of approximately 2.5 kg/m$^2$.

Preferably the viscoelastic acoustic barrier layer has a thickness below 6 mm.

Preferably the viscoelastic acoustic barrier layer has a thickness of 1.7 mm.

Preferably the viscoelastic acoustic barrier layer has a density is 1470 kg/m$^3$.

Preferably the viscoelastic acoustic barrier layer is a polymeric elastomer impregnated with material which in preferred forms is a particulate material.

Preferably the filler material is calcium carbonate.

Preferably the viscoelastic acoustic barrier layer is faced on one side with a nonwoven polyester of thickness approximately 0.05 mm.

Preferably the viscoelastic acoustic barrier layer is faced on the other side of the viscoelastic barrier or strips or pads by an aluminium film reinforced with polyester as a water barrier.

Preferably the viscoelastic acoustic barrier layer has a Young's Modulus of less than 344 kPa.

Preferably the acoustic laminate is incorporated into a wall structure utilising staggered studs and a cavity filled with polyester batts or other sound absorptive material.

Preferably the viscoelastic acoustic barrier layer is in the form of a composition which includes water, gelatine, glycerine and a filler material.

Preferably the composition includes:

5-40 wt % water 5-30 wt % gelatine 5-40 wt % glycerine; and 20-60 wt % filler material.

Preferably the composition includes 1 to 15 wt % of a group II metal chloride such as for example calcium chloride or magnesium chloride.

Preferably the composition includes 2 to 10 wt % magnesium chloride.

Preferably the composition further includes 0.5 to 7 wt % starch or gluten.

Preferably the starch is provided from the addition of cornflour to the composition.

Preferably the filler material is a non-reactive material with a high density.

Preferably the density is greater than 1 g/cm$^3$.

Preferably the density of the filler material is approximately 2.0 to 3.0 g/cm$^3$.

Preferably the filler material is chosen from any non-reactive material with a high density such as for example barium sulphate or KAOLIN.

Preferably the composition includes:

10-25 wt % water 5-20 wt % gelatine 10-25 wt % glycerine;

40-60 wt % filler material;

1-10 wt % magnesium chloride; and 0.5-3 wt % starch;

Preferably the composition further includes constituents such as for example ethylene and/or propylene glycols; polyvinyl alcohols; deodorisers; anti-oxidants and/or fungicides.

Preferably a wall construction is provided, incorporating additional layers of construction panel are provided, affixed to staggered studs.

Preferably the a wall construction is provided, which includes absorbent material in the form of polyester batts.

Also, an important effect, known as the knocking syndrome effect, is affected. This effect is known in the field of plasterboard dividing or partition walls, where a person knocks on the partition wall and is given a sensation that the building or wall is not solid because the wall returns a mid to high frequency knock. Some potential customers will not purchase or rent a dwelling if they are given the sensation that the wall is not solid, even though the acoustic performance of the wall itself may be better than, say, a double brick wall. Partition walls incorporating the laminate of the present invention or its preferred embodiments return a low-frequency, solid knock when tapped or knocked upon. This engenders a sense of security regarding the performance of the dwelling and wall.

DESCRIPTION OF PREFERRED EMBODIMENT

In order to enable a clearer understanding of the invention, drawings illustrating example embodiments are attached, and in those drawings.

Figure 1:
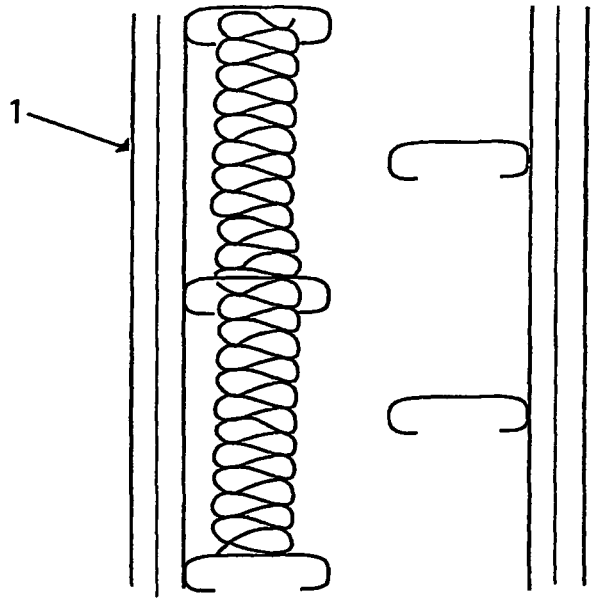
FIG. 1 is a schematic representation of a reference wall (typical of current construction method) used in testing to give a benchmark for measured results.

Referring to FIG. 1 there is shown a reference wall generally indicated at 1. The reference wall is a composite wall consisting of two layers of 13 mm thick fire rated plasterboard directly secured to 64 mm, 0.75 mm steel studs on one side. The wall is wholly repeated in mirror image about a centreline extending between the studs, with a 20 mm gap separating the studs. An infill cavity insulation of 50 mm glasswool 11 kg/m$^3$ is located between one set of the steel studs.

Figure 2:
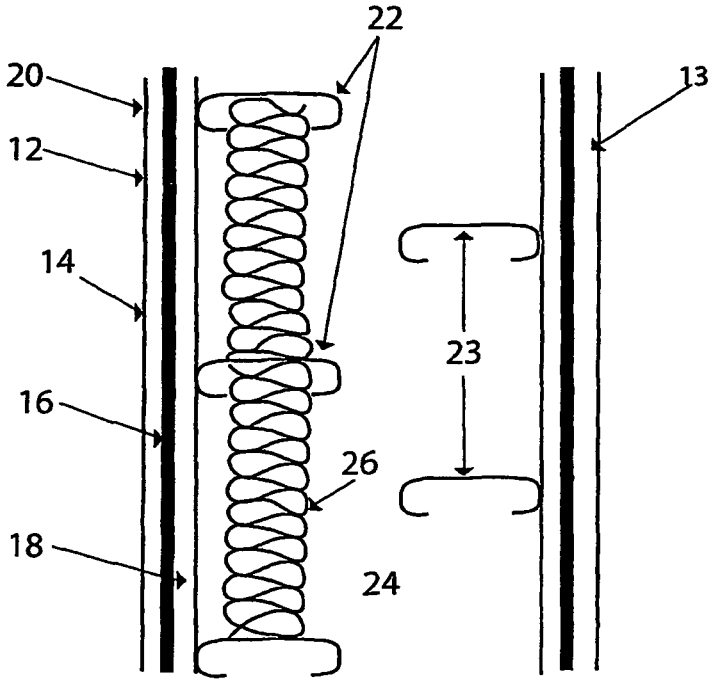
FIG. 2 is a schematic representation of a wall constructed in part using components of a preferred embodiment of the present invention.

A composite wall assembly utilising a preferred embodiment of the present invention is shown at FIG. 2 item 20. The composite wall assembly includes a laminate assembly 12 including a layer of 13 mm high density plasterboard 14, adhered to one face of a centre lamina of 2.5 kg loaded polymeric elastomer shown at 16, which is itself on its other side adhered to a 13 mm standard density plasterboard 18. The laminate assembly 12 is affixed to 64 mm, 0.6 mm thick steel studs 22. A cavity 24 is provided, filled on one side with 50 mm thick 48 kg/m$^3$ polyester insulation batts 26. On the other side of the cavity 24, studs 23 are provided, the studs 23 being staggered from studs 22. Affixed to the studs 23 is a laminate assembly 13, a mirror image of the laminate assembly 12.

Experimental Data Utilising Preferred Embodiments of the Present Invention

A reference wall and a composite wall, each in accordance with the above descriptions and Figures were constructed, and their sound transmission performance was tested. A +1.OdB correction was applied during testing to the reference wall to align its glasswool performance with that of the composite wall. The composite wall utilised 48 kg/m$^3$ and the reference wall used 1 lkg/m$^3$ glasswool to infill one side of the cavity.

TABLE 1

Comparison Results of the Testing Conducted.

| Description | ⅓ Octave Band Centre Frequency | | | | | | | | |
|---|---|---|---|---|---|---|---|---|---|
| | 100 | 125 | 160 | 200 | 250 | 315 | 400 | 500 | 630 |
| Composite Wall | 45 | 45 | 48 | 50 | 53 | 56 | 57 | 59 | 61 |
| Reference Wall | 37 | 42 | 44 | 47 | 51 | 51 | 55 | 58 | 61 |
| Improvement | 8 | 3 | 4 | 3 | 2 | 5 | 2 | 1 | 0 |

| Description | ⅓ Octave Band Centre Frequency | | | | | | | | |
|---|---|---|---|---|---|---|---|---|---|
| | 800 | 1000 | 1250 | 1600 | 2000 | 2500 | 3150 | 4000 | 5000 |
| Composite Wall | 64 | 66 | 67 | 67 | 68 | 70 | 73 | 77 | 78 |
| Reference Wall | 62 | 64 | 66 | 68 | 64 | 61 | 64 | 64 | 64 |
| Improvement | 2 | 2 | 1 | −1 | 3 | 9 | 9 | 13 | 14 |

Figure 3:
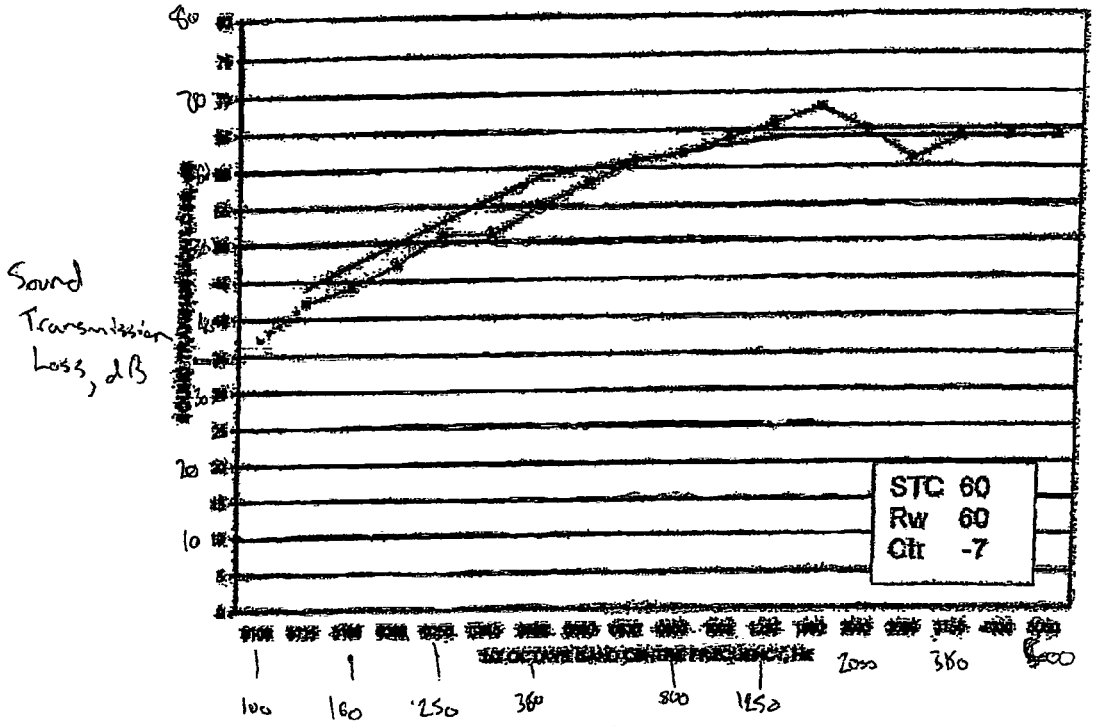
FIG. 3 is a graph showing results of benchmark transmission loss testing of the reference wall shown in FIG. 1 (an STC60 curve is superposed on the test results)
Figure 4:
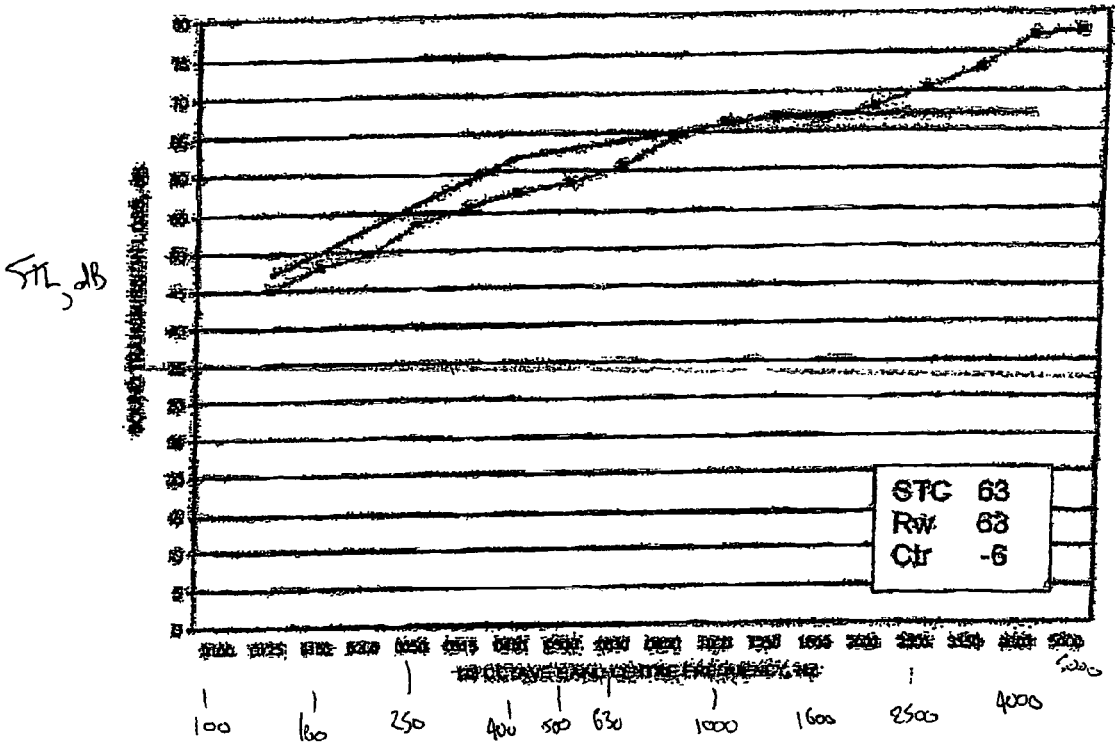
FIG. 4 is a graph showing results of transmission loss testing of the wall shown in FIG. 2 (an STC63 curve is superposed on the test results)
Figure 5:
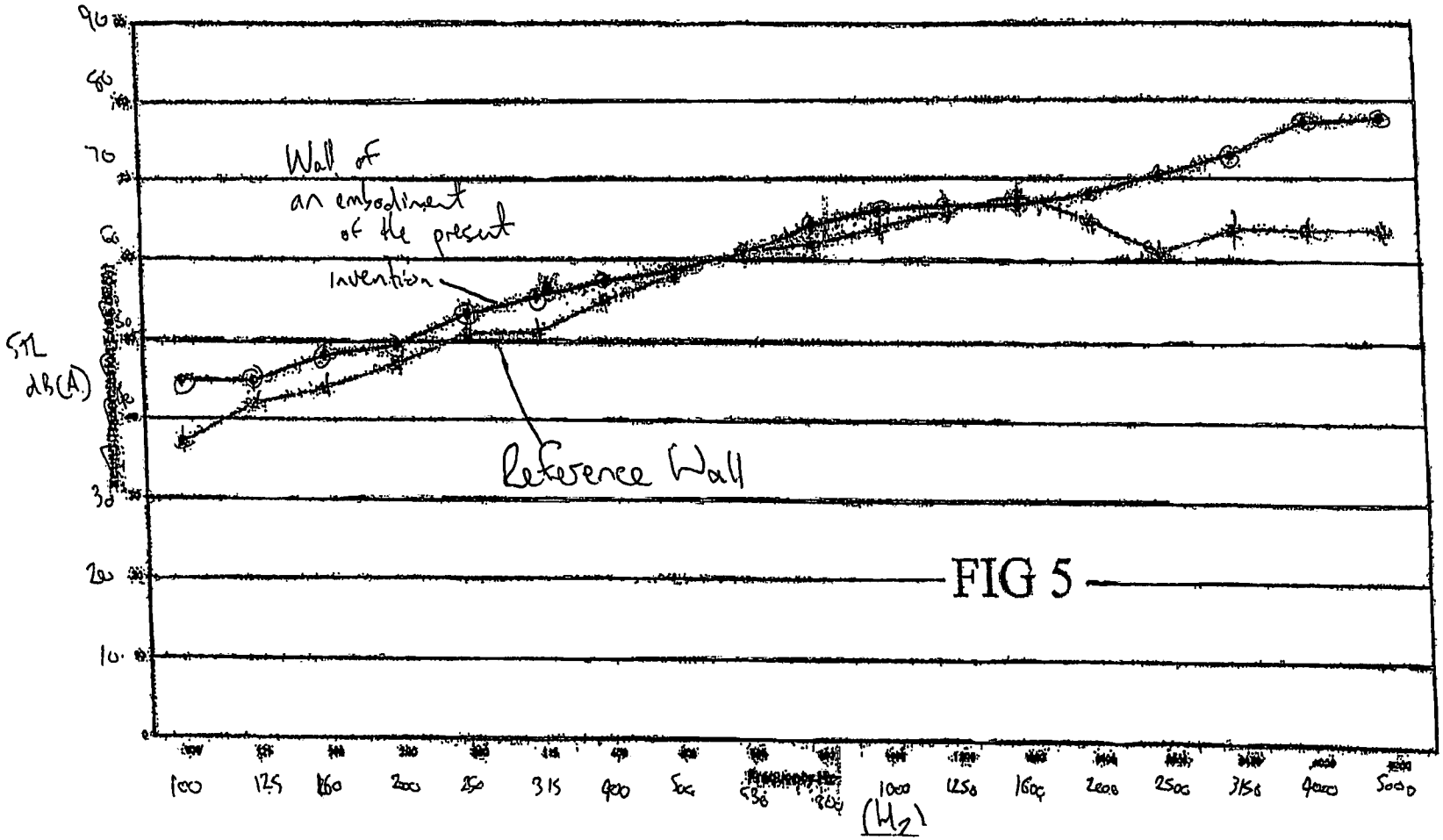
FIG. 5 is a graph showing graphs in FIGS. 3 and 4 superposed on similar axes.

FIGS. 3, 4 and 5 show the tabulated results graphically.

The table above and the graphs show the improvement in acoustic performance that occurs in the nominated frequency regions due to the addition of a lamina of loaded polymeric elastomer 16, surface density of 2.5 kg/m$^2$, between a sheet of 13 mm high-density plasterboard 14 and a sheet of 13 mm normal density plasterboard 18. Normal experience teaches that a very small improvement of performance in a so-called coincidence dip frequency region (2500 Hz in this case) can occur where plasterboards of differing densities are adhered together. This improvement is normally only of the order of 2 to 3 dB. However, the performance gain in this experiment for the composite wall assembly 20 is 9 dB, with significant gains in performance occurring above this frequency.

The combined graph (FIG. 5) and table shows an improvement in the frequency regions of 100 Hz to 400 Hz and from 2000 Hz to 5000 Hz.

When the concept of Acoustic Performance Index is applied to the composite wall assembly 20 (FIG. 2), the score is extremely high. Acoustic Performance Index takes into account the cost of the wall compared to its acoustic performance and to the thickness of the wall and the floor space cost. Thickness is a very important consideration as floor space in a typical apartment is AU$6000 per square metre. The composite wall assembly 20 is only 206 mm wide and has an acoustic performance that can only be matched by expensive wall systems which are 280 mm wide or more. The composite wall system has a high Acoustic Performance Index of $R_w$ greater than or equal to 55.

Figure 6:
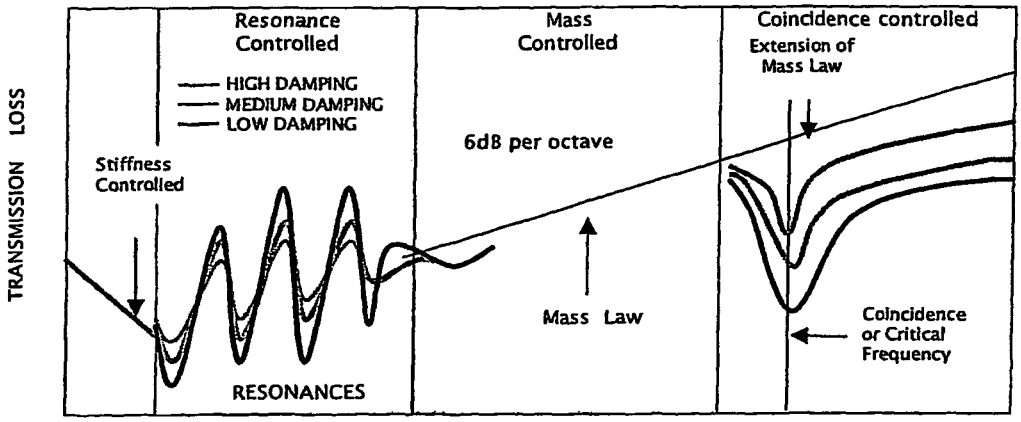
FIG. 6 is a graph showing expected coincidence effects of prior art stiff panels.
Figure 7:
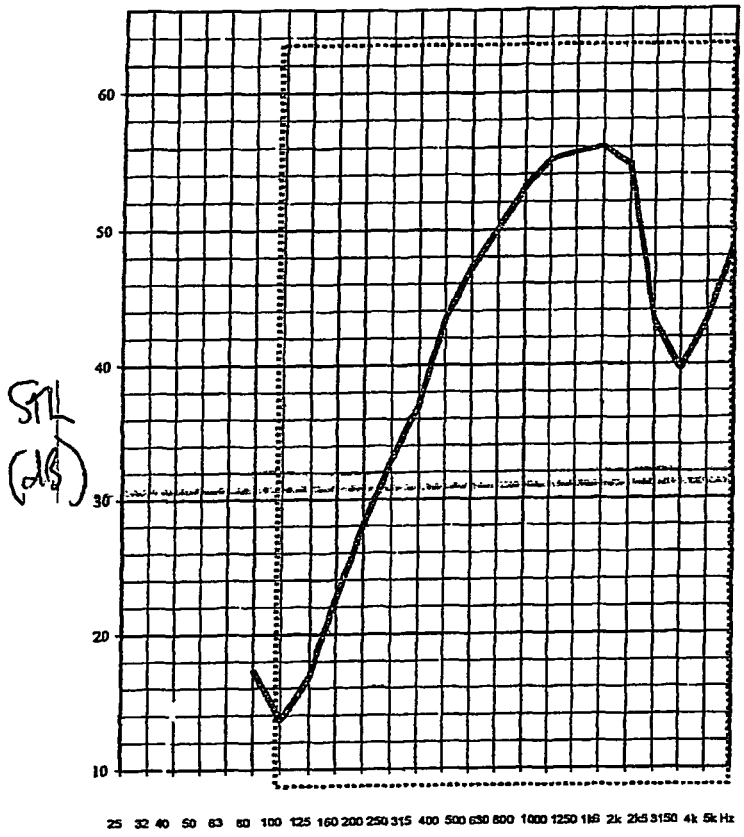
FIG. 7 shows Transmission Loss (TL) test results of a reference wall of the prior art displaying coincidence dip effects.
Figure 8:
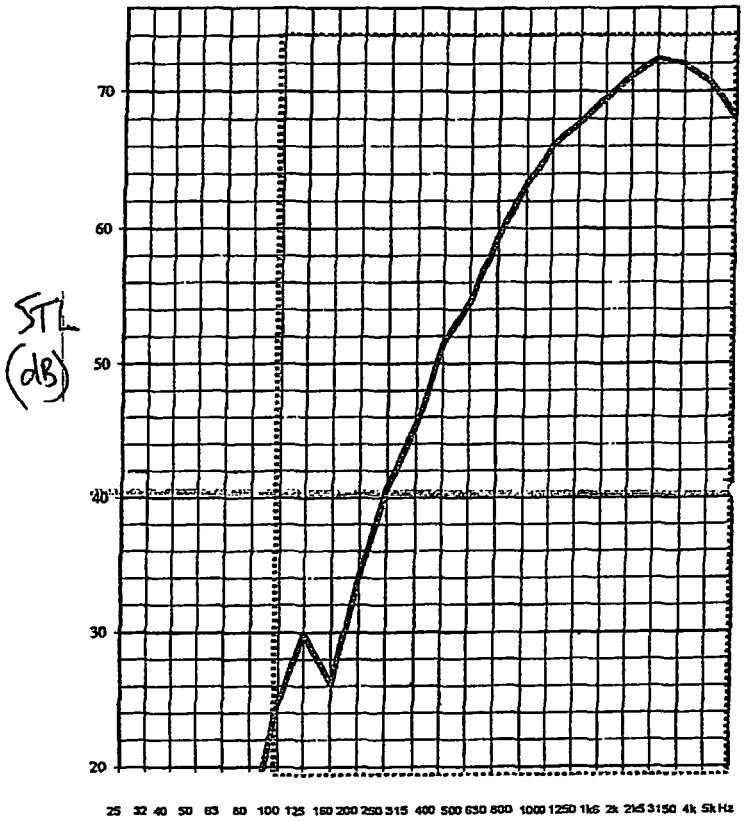
FIG. 8 shows TL test results of a wall treated with preferred embodiments of the present invention, showing the much reduced coincidence dips, if detectable at all.

The combination of the construction panel and viscoelastic barrier provide an unexpected synergy. It would be expected that adding a very thin layer of dense material would only provide a small benefit according to the mass law. For example, at 1250 Hz, increasing the mass by 6 kg/m$^2$, (as we have shown above in the testing) we are expected to produce a gain in transmission loss of 2 dB (see Also FIG. 6). However, in the testing above, at that frequency, we see TL gain of 21 dB.

Furthermore, the expected coincidence dip does not eventuate. We would have expected that the change in stiffness would have given us a change in transmission loss of 1.6 dB at 2500 Hz. However, we demonstrated at that frequency, a change of 18 dB.

By affixing viscoelastic material to construction panel in the form of plasterboard the panel resonance at low frequencies was reduced and stiff panel 'Coincidence effects' were greatly reduced at higher frequencies, especially the frequencies at which the ear is most sensitive.

Other embodiments have been tested: In one embodiment, strips of viscoelastic material covering 25-50% of the panel surface were affixed to the stiff construction panel. The strips were paced by air gaps which formed small voids of less than 4 mm thickness. The resulting damping is apparently as effective as having a full sheet of viscoelastic barrier material on the construction panel, in the sense that shear strains within the viscous-elastic material are still induced which greatly reduces or eliminates the stiff panel construction 'Coincidence effect' in the band width 1000-4000 Hz, which is the ear's most sensitive region.

It is believed that the small spaced air gaps (2-4 mm in thickness) between the construction panels, spaced also between viscoelastic strips or pads appear to act the same way as the actual viscoelastic material. That is, they do not allow the bending wave generated in the panel to reach the speed of sound in the medium surrounding the panel and thus avoid coincidence dips and phase reinforcement.

It should be noted that shear strains in the viscoelastic treatment actually transform bending waves into heat energy which is noiseless.

Figure 10:
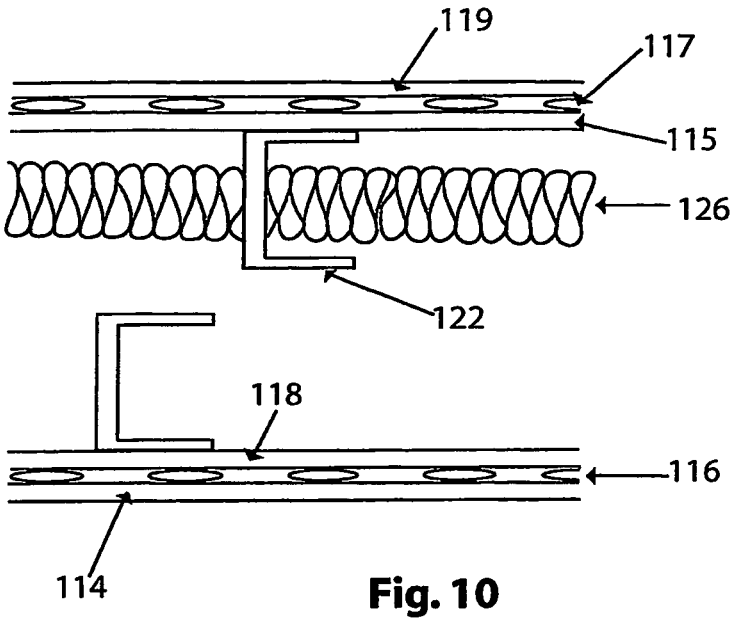
FIG. 10 shows the composition of the reference wall tested in FIG. 9.
Figure 12:
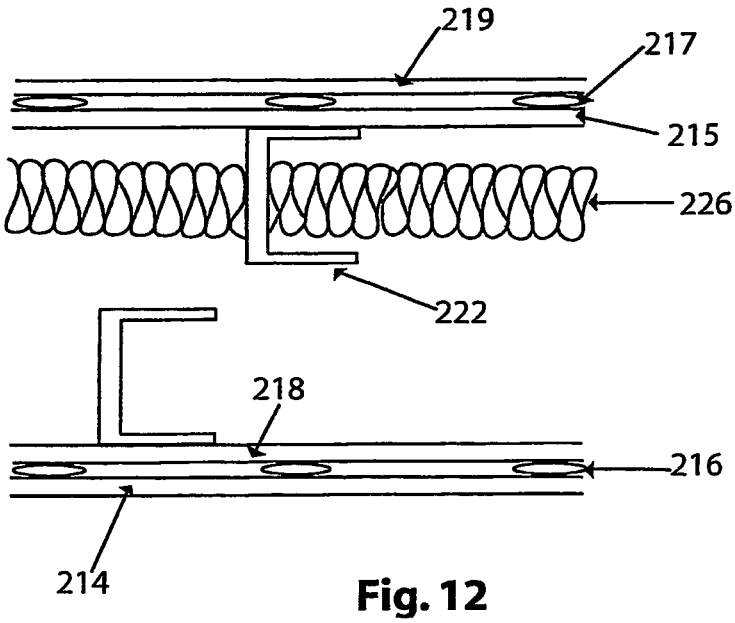
FIG. 12 shows the composition of the reference wall tested in FIG. 11.

Advantageously, preferred embodiments such as for example that shown at FIGS. 10 and 12 of this invention function via the following mechanism:

Most rigid materials will be sympathetic to vibration at one or more frequencies, and damping materials are an efficient and effective means to control vibration and structure-borne radiated noise.

'Damping' is the energy dissipation properties of a material or system under cyclic stress, and damping vibration can significantly reduce the creation of secondary noise problems.

With the above two paragraphs in mind, the specially formulated non slip viscoelastic strips or pad matrix situated on the construction panel are in contact with the construction panel effectively increasing the vibrations' decay rate. Decay rate is the speed in dB/second at which the vibration reduces after panel excitation has ceased—the higher the decay rate, the better the acoustic performance.

By applying viscoelastic barrier material in strips and pads to construction board in the form of plasterboard the panel resonance at low frequencies was reduced and 'Coincidence effects' were also substantially eliminated.

Although not shown in the drawings, a method of adhering the construction panel and viscoelastic barrier together has shown excellent adhering properties, and that is to utilise a pouring head which pours a hot or warm viscoelastic composition directly onto the construction board. The composition cools and then grips the face of the board. This may be used to make sandwiches of the compound, ie a second layer of construction board on to an upper surface of the cooling or curing composition.

Figure 9:
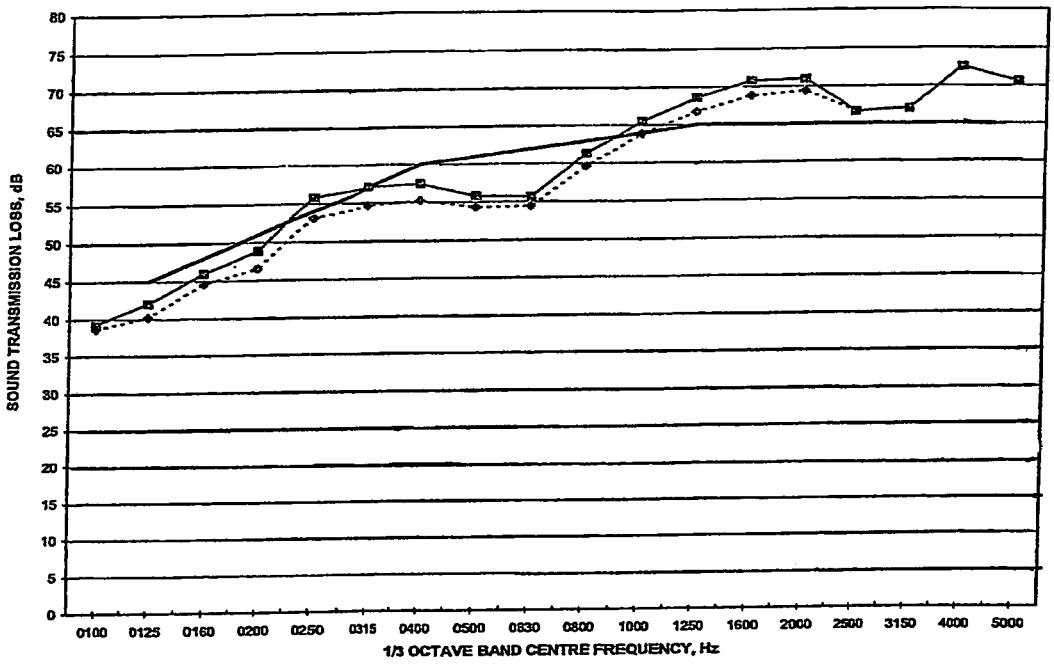
FIG. 9 shows TL test results of a wall treated with another preferred embodiment of the present invention—ie spaced viscoelastic strips (an STC curve is superposed on the results, and corrected data is also shown in broken line)

Further experiments have been conducted on other preferred embodiments:

In one embodiment, a wall was constructed as shown in FIG. 10, starting on the outside: 13 mm standard plasterboard panel 114; viscoelastic barrier 116 in strips 50 mm wide, spaced at 50 mm intervals along the panel 114; 13 mm standard plasterboard panel 118; 64 mm staggered studs 122 in 90 mm track; 20 kg/m$^3$ polyester batt 126, 13 mm standard plasterboard panel 115; viscoelastic barrier in strips 50 mm wide 117, spaced at 50 mm intervals; 13 mm standard plasterboard panel 119. This wall underwent TL testing and the results are shown at FIG. 9. Only a slight coincidence dip occurs at 1000-4000 Hz. Overall, the STC and corrected transmission loss data are unexpectedly high for this type of construction.

Figure 11:
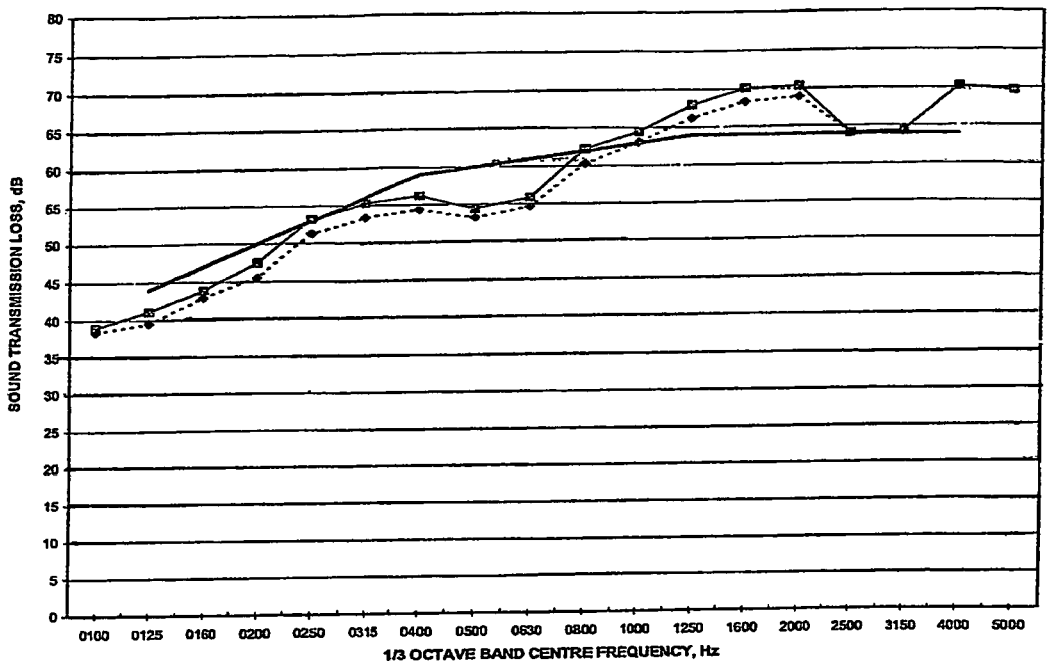
FIG. 11 shows TL test results of a wall treated with yet another preferred embodiment of the present invention—ie viscoelastic pads spaced on a matrix (an STC curve is superposed on the results, and corrected data is also shown in broken line)

Similarly, a wall constructed as shown in FIG. 12 has a plurality of 50 mm viscoelastic strips 216 spaced with a 150 mm gap between each. The TL results appear at FIG. 11 and they seem very similar to those shown in FIG. 10, the only difference being the spacing between the viscoelastic strips. These results show the mechanism of the trapped air apparently working as a viscoelastic medium which reduces the buildup of transverse waves in the panel, without the mass or expense of an actual viscoelastic medium. Again, the STC and corrected transmission loss data are unexpectedly high for this type of construction.

Some wall constructions do not include any absorptive batt material, and the results appear to be better than similar walls without absorptive batts.

A feature of a preferred embodiment of the present invention will become better understood from the following example of a preferred but non-limiting embodiment thereof.

Example 100 g of water together with 100 g of glycerine and 10 g of starch was mixed and then heated to a temperature of 85° C. 80 g of gelatine and 20 g of magnesium chloride was then dissolved into the mixture and a gel was formed. 310 g of barium sulphate was then added to the gel providing a composition with good flexibility, elasticity, tensile strength, and density with good film forming properties. The composition had the following composition by weight:

16% water;
16% glycerine;
1.5% starch;
13% gelatine;
3.5% magnesium chloride; and
50% barium sulphate.

The composition was then extruded into a flat sheet and bonded onto an aluminium film and then brought down to room temperature whereby the composition cured to form a sheet of composite material of 4 mm in thickness that showed excellent sound dampening properties.

Finally, it is to be understood that various alterations, modifications and/or additions may be incorporated into the various constructions and arrangements of parts without departing from the spirit or ambit of the invention.

The invention claimed is:

1. A construction panel laminate suitable for use in partition wall assemblies and having improved acoustic properties, the construction panel laminate including: a first flat construction panel; a viscoelastic acoustic barrier material layer affixed to the first flat construction panel, wherein the viscoelastic acoustic barrier material layer is prepared from a composition including water, gelatine, glycerine and a filler material.

2. A construction panel laminate in accordance with claim 1 wherein a second flat construction panel is affixed to an outer face of the viscoelastic barrier in order to provide a three-layer laminate so as to provide a type of captive, or constrained layer effect.

3. A construction panel laminate in accordance with claim 2 wherein the flat construction panel or the second flat construction panel is in the form of plasterboard, medium-density fibreboard, plywood, fibre-cement sheeting or timber.

4. A construction panel laminate in accordance with claim 2 wherein the viscoelastic acoustic barrier material layer is affixed to an adjacent flat construction panel by adhesive.

5. A construction panel laminate in accordance with claim 2 wherein the viscoelastic acoustic harrier material layer is poured onto the first construction panel and cures on the panel, bonding to the panel during curing, providing increased bonding strength after cooling.

6. A construction panel laminate in accordance with claim 1 wherein the viscoelastic acoustic barrier material layer is in the form of discrete viscoelastic acoustic barrier material portions spaced across the construction panel.

7. A construction panel laminate in accordance with claim 1 wherein the viscoelastic acoustic barrier material portions are affixed to the construction panel in strips along an axis parallel to respective panel faces.

8. A construction panel laminate in accordance with claim 1 wherein a matrix of viscoelastic pads are affixed to the first construction panel, each pad spaced from an adjacent pad across a face of the panel in two non-collinear axes.

9. A construction panel laminate in accordance with claim 1 wherein the viscoelastic acoustic barrier layer has a density within a range of 1000 kg/m$^3$ to 3000 kg/m$^3$.

10. A construction panel laminate in accordance with claim 1 wherein the viscoelastic acoustic barrier layer has a thickness below 6 mm.

11. A construction panel laminate in accordance with claim 1 wherein the viscoelastic acoustic barrier layer is faced on one side with a nonwoven polyester of thickness approximately 0.05 mm.

12. A construction panel laminate in accordance with claim 1 wherein the viscoelastic acoustic barrier layer is faced on the other side of the viscoelastic barrier material layer by an aluminum film.

13. A partition or dividing wall incorporating a construction panel laminate in accordance with claim 1 wherein the partition wall includes staggered studs and a cavity filled with polyester bans or other sound absorptive material.

14. A construction panel laminate in accordance with claim 1 wherein the acoustic laminate inhibits transmission at the frequencies typically forming a coincidence dip in construction panels, being approximately 1000-4000 Hz.

15. A construction panel laminate in accordance with claim 1 wherein the composition includes:

5-40 wt % water
5-30 wt % gelatine
5-40 wt % glycerine; and
20-60 wt % filler material.

16. A construction panel laminate in accordance with claim 1 wherein the composition includes 1 to 15 wt % of a group II metal chloride.

17. A construction panel laminate in accordance with claim 16 wherein the composition includes 2 to 10 wt % magnesium chloride.

18. A construction panel laminate in accordance with claim 1 wherein the composition further includes 0.5 to 7 wt % starch or gluten.

19. A construction panel laminate in accordance with claim 1 wherein the composition further includes one or more constituents selected from ethylene and/or propylene glycols; polyvinyl alcohols; deodorisers; anti-oxidants and/or fungicides.

* * * * *

UNITED STATES PATENT AND TRADEMARK OFFICE

CERTIFICATE OF CORRECTION

PATENT NO. : 8,448,389 B2
APPLICATION NO. : 11/578340
DATED : May 28, 2013
INVENTOR(S) : Doneux et al.

It is certified that error appears in the above-identified patent and that said Letters Patent is hereby corrected as shown below:

In the Claims

Column 8, line 24, claim 5, please replace “harrier” with -- barrier --.

Column 8, line 57, claim 13, please replace “bans” with -- batts --.

Signed and Sealed this
Twenty-ninth Day of October, 2013

Teresa Stanek Rea

Teresa Stanek Rea
*Deputy Director of the United States Patent and Trademark Office*